US006893224B2

(12) United States Patent
Murphy

(10) Patent No.: US 6,893,224 B2
(45) Date of Patent: May 17, 2005

(54) METHODS AND APPARATUS FOR ASSEMBLING TURBINE ENGINES

(75) Inventor: John Thomas Murphy, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 151 days.

(21) Appl. No.: 10/316,473

(22) Filed: Dec. 11, 2002

(65) Prior Publication Data

US 2004/0115052 A1 Jun. 17, 2004

(51) Int. Cl.[7] ..... F01D 5/32
(52) U.S. Cl. ..... 416/220 R
(58) Field of Search ..... 416/220 R, 221, 416/215, 216, 218

(56) References Cited

U.S. PATENT DOCUMENTS 2,220,918 A * 11/1940 Smith ..... 416/191
2,445,154 A * 7/1948 Reed ..... 416/221
2,800,298 A * 7/1957 Schellens ..... 416/216
2,805,838 A * 9/1957 Pickup ..... 416/95
4,676,723 A 6/1987 Kiger et al.
4,702,673 A 10/1987 Hansen et al.
4,711,007 A 12/1987 Conrad
4,767,247 A 8/1988 Partington et al.
4,767,273 A 8/1988 Partington
4,767,275 A 8/1988 Brown
4,915,587 A 4/1990 Pisz et al.
5,720,596 A 2/1998 Pepperman
6,030,178 A 2/2000 Caruso
6,168,377 B1 1/2001 Wolfe et al.
6,287,079 B1 9/2001 Gosling et al.
6,416,286 B1 7/2002 Roberts et al.
6,438,837 B1 8/2002 Berry et al.
6,439,844 B1 8/2002 Turnquist et al.

* cited by examiner

*Primary Examiner*—Ninh H. Nguyen
(74) *Attorney, Agent, or Firm*—Armstrong Teasdale LLP

(57) ABSTRACT

A method of assembling a turbine comprises coupling at least one bucket assembly. The bucket assembly including an upstream side, a downstream side, a blade extending therebetween and a dovetail extending radially inwardly from the blade to a rotor. The method further comprises fixedly securing the at least one bucket assembly to the rotor with a shear pin that extends from the bucket assembly upstream side to the bucket assembly downstream side.

16 Claims, 4 Drawing Sheets

METHODS AND APPARATUS FOR ASSEMBLING TURBINE ENGINES

BACKGROUND OF THE INVENTION

The present invention relates generally to turbine engines and more particularly to methods and apparatus for securing blades used within turbine engines.

At least some known turbine rotor assemblies include a rotor to which a plurality of blades are coupled. The blades are arranged in axially-spaced stages extending circumferentially around the rotor. Each stage includes a set of stationary blades or nozzles, and a set of cooperating rotating blades, known as buckets.

Each bucket includes a dovetail that is used to couple the bucket to an annular slot defined by the rotor. More specifically, each dovetail includes a recessed portion, know as a hook, that is defined by axial tangs and that enables each blade to be slidably coupled to the rotor.

Each rotor slot is defined by a pair of substantially parallel retaining rings. During assembly, a first bucket dovetail is inserted into the retaining rings through a loading slot defined within the retaining rings. Adjacent buckets are also coupled to the rotor through the loading slot and slid circumferentially into position. The last bucket, known as the closure bucket, is coupled to the rotor and remains within the loading slot. All of the buckets, with the exception of the closure bucket, are coupled to the rotor by the retaining ring. Known closure buckets are coupled in position within the loading slot by a pair of shear pins which are inserted axially between the closure bucket and the circumferentially adjacent buckets. However, some rotors do not permit axial insertion of shear pins due to close stage to stage spacing.

BRIEF DESCRIPTION OF THE INVENTION

In one aspect, a method of assembling a turbine is provided. The method comprises coupling at least one bucket assembly including an upstream side, a downstream side, a blade and a dovetail, to a rotor. The method also includes fixedly securing the bucket assembly to the rotor with a shear pin that extends from the bucket assembly upstream side to the downstream side.

In another aspect, a rotor assembly for a turbine is provided. The rotor assembly comprises a plurality of bucket assemblies secured to a rotor. Each bucket assembly comprises an upstream side, a downstream side, a blade, and a dovetail. Each blade extends from each dovetail. The plurality of bucket assemblies comprise at least a first bucket assembly and at least a second bucket assembly. At least one shear pin secures the at least one first bucket assembly to the rotor such that the shear pin extends from the upstream side to the downstream side of the bucket assembly.

In a further aspect, a turbine comprising at least one rotor assembly. The rotor assembly comprising at least one rotor and a plurality of bucket assemblies secured to the rotor. Each bucket assembly comprises an upstream side, a downstream side, a blade and a dovetail. The blade extends radially from the dovetail. The plurality of bucket assemblies comprises at least one first bucket assembly and at least one second bucket assembly. At least one shear pin secures the at least one first bucket assembly to the rotor such that the shear pin extends from the bucket assembly upstream side to the bucket assembly downstream side.

DETAILED DESCRIPTION OF THE INVENTION

Figure 1:
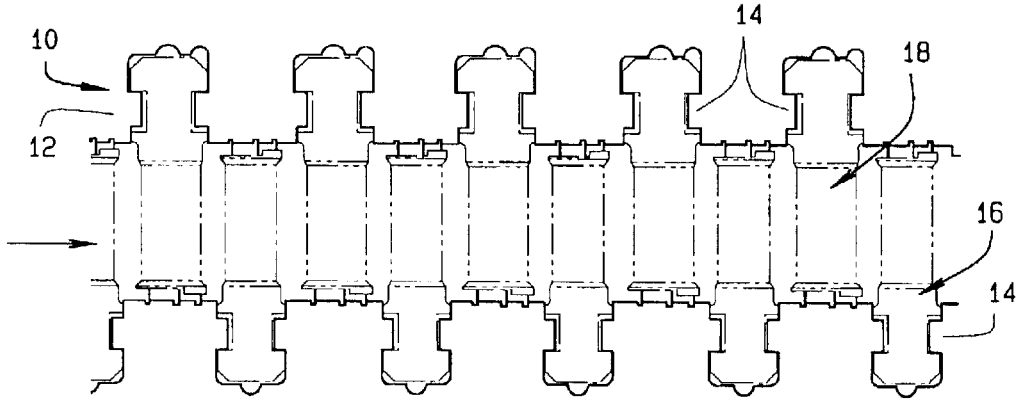
FIG. 1 is a partial cross-sectional schematic view of a rotor assembly.

FIG. 1 is a partial cross-sectional schematic illustration of a steam turbine 10 including a rotor assembly 12 (hereafter referred to as a rotor) including a plurality of axially spaced stages 14 used to couple buckets 16 to a rotor assembly 12. A series of nozzles 18 extend in rows between adjacent rows of buckets 16. Nozzles 18 cooperate with buckets 16 to form a stage and to define a portion of a steam flow path indicated by the arrow that extends through turbine 10.

In operation, steam enters an inlet end (not shown) of turbine 10 and moves through turbine 10 parallel to the rotor 12. The steam strikes a row of nozzle 18 and is directed against buckets 16. The steam then passes through the remaining stages, thus forcing buckets 16 and rotor 12 to rotate.

Figure 2:
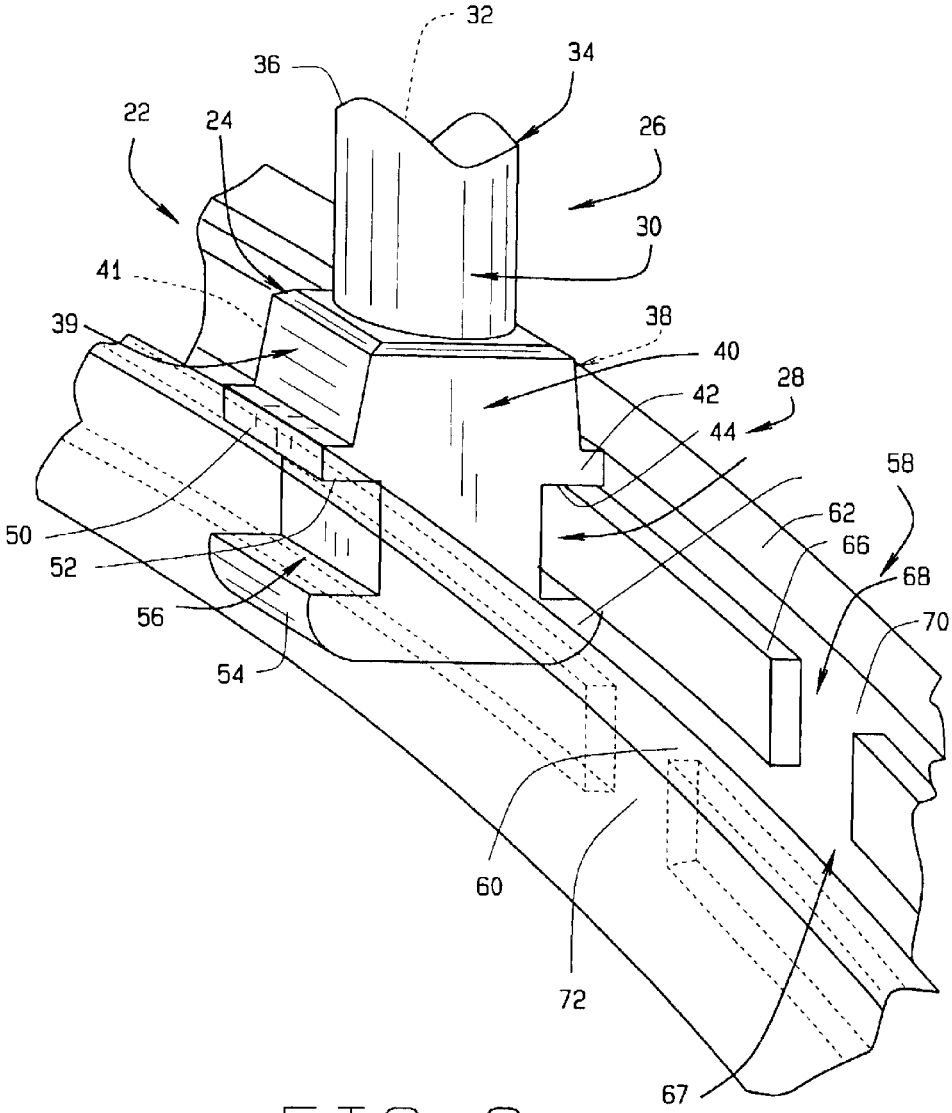
FIG. 2 is a partial perspective view of a bucket assembly coupled within the rotor assembly shown in FIG. 1.
Figure 3:
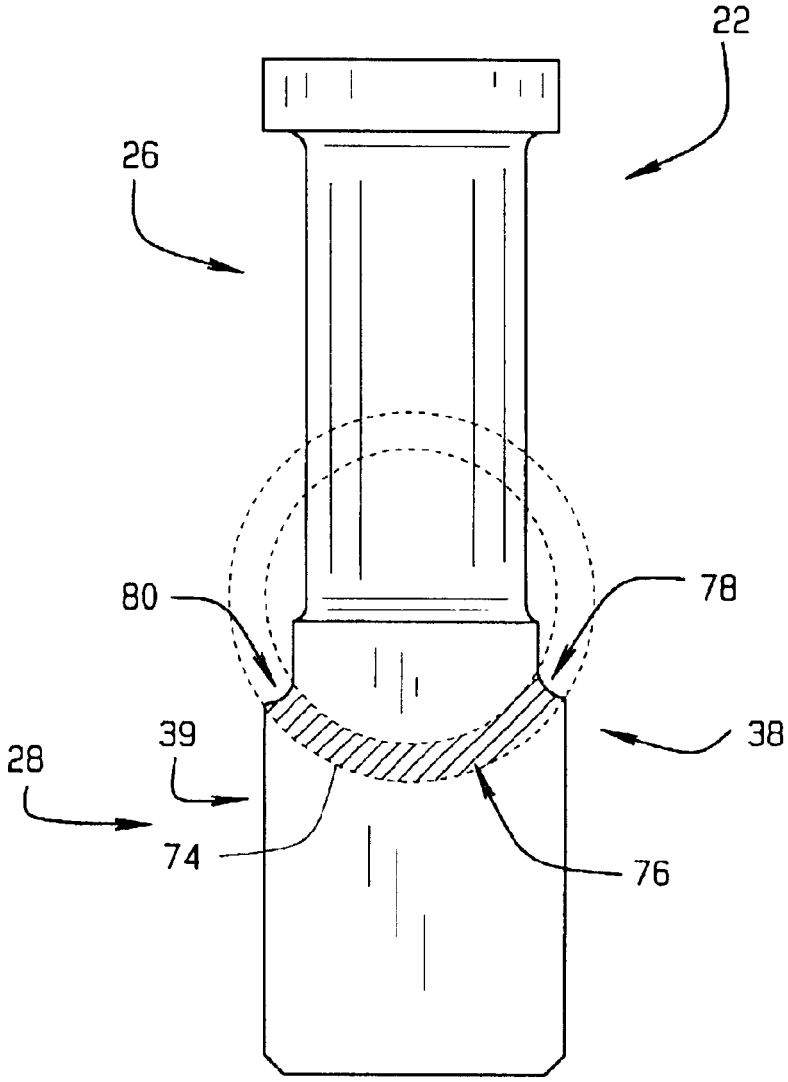
FIG. 3 is a side cross-sectional view of a closure bucket assembly that may be used with the rotor assembly shown in FIG. 1.

FIG. 2 is a perspective view of a bucket assembly 22 coupled to rotor 12 and FIG. 3 is a side cross-sectional view of a closure bucket assembly that may be used with the rotor assembly shown in FIG. 1. Bucket assembly 22 includes a platform 24, a blade 26 extending radially outward from platform 24, and a dovetail 28 extending radially inward from the platform 24. Blade 26 includes a first contoured sidewall 30 and a second contoured sidewall 32. First sidewall 30 is convex and defines a suction side of blade 26, and second sidewall 32 is concave and defines a pressure side of blade 26. Sidewalls 30 and 32 are joined at a leading edge 34 and at an axially-spaced trailing edge 36 of blade 26.

Platform 24 includes an upstream side 38 and an opposite downstream side 39. In the exemplary embodiment, upstream side 38 and downstream side 39 are substantially parallel. Bucket assembly 22 has a first tangential face 40 and an opposite second tangential face 41 that each extend between upstream and downstream sides 38 and 39. In one embodiment, upstream side 38 includes a side shoulder 42, known as an outer tang, that extends substantially perpendicularly from upstream side 38 and defines an overhang 44. A dovetail tang 46 also extends substantially perpendicularly from the upstream side 38 and is substantially parallel to the side shoulder 42 such that an upstream side slot 48 is defined between tang 46 and shoulder 42.

Bucket assembly downstream side 39 includes a side shoulder 50 that extends substantially perpendicularly from downstream side 39. In an exemplary embodiment, shoulder 50 is substantially co-axially aligned with respect to upstream shoulder 42. Side shoulder 50 defines a downstream side overhang 52. A dovetail tang 54 also extends substantially perpendicularly from the downstream side 39 and is substantially parallel to side shoulder 50 such that a downstream side slot 56 is defined between. In the exemplary embodiment, tang 54 is substantially co-axially aligned with respect to dovetail tang 46.

Rotor 12 includes at least one annular slot 58 that facilitates coupling each bucket assembly dovetail 28 to rotor 12. Slot 58 is defined by side slot walls 60 and 62 and a radially inward slot wall 64. Substantially annular retaining rings 66 extend from each side slot walls 60 and 62 to retain each dovetail 28 within dovetail slot 58. Dovetail slot 58 includes loading slot 68 used to enable radial entry of bucket assemblies 22 into dovetail slot 58. Loading slot 68 has side slot walls 70 and 72 that do not include retaining rings 66 such that each bucket assembly dovetail 28 may be slidably coupled into dovetail slot 58 without dovetail tangs 46 or 54 contacting retaining rings 66.

After each respective bucket assembly 22 is inserted with loading slot 68, that respective bucket assembly 22 is circumferentially slid into dovetail slot 58 such that the retaining rings 66 are disposed in each respective bucket assembly upstream and downstream side slot 48 and 56. Additional bucket assemblies 22 are then slidably coupled to rotor 12 in a similar fashion, serially about 12. Bucket assembly is known as a closure bucket assembly, and is inserted into loading slot 68 to facilitate securing all closure bucket assemblies 22 to rotor 12. The closure bucket assembly is known in the art and includes a dovetail that does not include dovetail tangs 46 or 54, but rather a substantially planar upstream sidewall and a substantially planar downstream sidewall for abutting against the loading slot walls 70 and 72 when the closure bucket is inserted into loading slot 68. Thus, a first tangential face of the closure bucket assembly contacts a first circumferentially-spaced adjacent bucket assembly 22, and a second tangential face of the closure bucket assembly contacts an oppositely disposed second circumferentially-spaced adjacent bucket assembly 22.

In operation, the blades 26 are urged in the radial direction by the centrifugal force exerted on them as a result of their rotation and in the tangential direction by the aerodynamic force exerted on them as a result of the fluid flow. However, the close match in the size and shape of the dovetail tangs 46, 54 of the bucket assembly 22 and the retaining rings 66 of the dovetail slot 58 of the rotor prevents movement of the bucket assemblies 22 in the radial and tangential directions. The blades 26 are also urged axially backward during operation by a relatively small force exerted on them by the pressure drop across the row. However, the closure bucket assembly (positioned in the loading slot 68) needs to be secured in the radial direction. Hence, it is necessary to restrain the closure bucket assembly in the radial direction to prevent the closure bucket 22 from being released from the loading slot 68.

The present invention provides an advantage over known shear pins, or radial oriented grub screws, which entails drilling and tapping the assembled stage of bucket assemblies and then peaning material over the screws. Drilling and tapping the grub screw holes would normally require a large machining station, such as a horizontal boring mill, and would result in causing a localized stress riser in the rotor. The insertion of axial oriented shear pins requires large stage to stage spacing and by relatively large upstream and downstream side shoulders.

Closely spaced stages of bucket assemblies 22 and relatively small upstream and downstream side shoulders 42 and 50, implementing drilling axially-orientated pins is difficult and time consuming. In addition, removing a closure bucket assembly is time-consuming which requires removing material peaned over the screw, extracting the screw and then later re-drilling the tap with a larger diameter in order to secure the closure bucket again with a different and larger diameter grub screw.

A bucket assembly 22 is secured to the rotor 12 by inserting a shear pin 74 as shown in FIG. 3. The shear pin 74 having an arcuate cross-sectional profile is disposed in a channel 76. In one embodiment, channel 76 is formed to extend generally from the upstream side 38 to the downstream side 39. In another embodiment, channel 76 is formed to extend from the upstream side 38 having a first opening 78 to the downstream side 39 having a second opening 84, as shown in FIG. 3.

Figure 4:
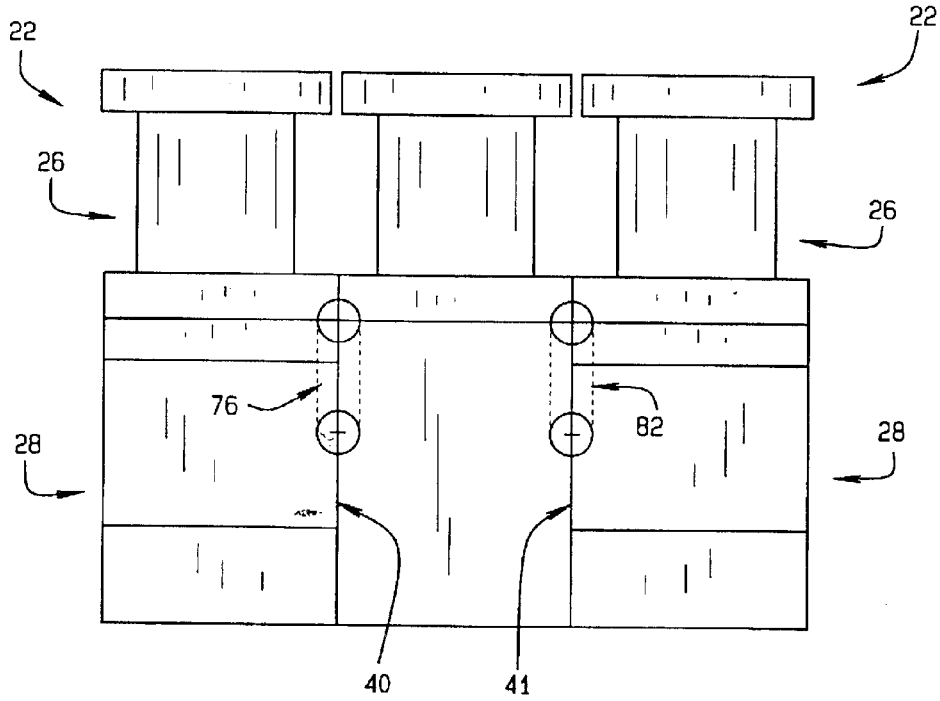
FIG. 4 is a front view of the rotor shown in FIG. 1, including the closure bucket assembly shown in FIG. 3 coupled in position.

In one embodiment, a plurality of channels having an arcuate cross-sectional profile extend from the upstream side 38 to the downstream side 39 of the bucket assembly 22. As shown in FIG. 4, a first channel 76 is formed at the interface of the first tangential face 40 of the closure bucket assembly and the dovetail 28 of the adjacent bucket assembly. A second channel 82 is formed at the interface of the second tangential face 41 of the closure bucket assembly and the dovetail 28 of the adjacent bucket assembly. Thus, the channels 76, 82 are partially machined in the dovetail 28 of the closure bucket assembly and partially machined in the dovetail 28 of the adjacent bucket assembly. With shear pins inserted into channel 76, 82, The shear pin thereby secures the bucket assembly 22 to the adjacent bucket assemblies. Since the closure bucket assembly is secured to the adjacent bucket assemblies, the closure bucket assembly centrifugal load is taken out by the two adjacent bucket assembly dovetail tangs.

In another embodiment, the channel 76 having an arcuate cross-sectional profile extends through a loading slot wall of the dovetail slot 58, through the upstream side 38 to the downstream side 39 of the bucket assembly 22 and out through the opposing loading slot wall of the dovetail slot 58. In an alternative embodiment, the channel 76 extends through a portion of the retaining ring 66.

In a further embodiment, at least one channel extends from a loading slot wall through the interface of an axial face of the dovetail of the closure bucket assembly and the dovetail of an adjacent bucket assembly and out to the opposing loading slot wall.

If the closure bucket needs to be removed, the arcuate shear pin 74 is simply tapped on one end at the first opening 78, thereby thrusting the other end of the shear pin out the second opening 80 of the channel 76. The arcuate shear pin 74 is then removed thereby allowing the closure bucket assembly to be released from the loading slot 68. Upon re-insertion of the closure bucket assembly into the loading slot 68, the same arcuate shear pin 74 is placed into the same channel 76 to once again secure the closure bucket assembly to the rotor 12.

The above-described rotor assembly is cost-effective and time saving. The rotor assembly includes an arcuate shear pin that facilitates securing a bucket assembly to the rotor assembly, thus reducing the amount of time to remove and replace a bucket assembly. Because the shear pin may have an arcuate cross-sectional profile, the shear pin is easily removed from the channel and is more easily coupled to the closure bucket than other known shear pins. As a result, the shear pin facilitates extending a useful life of the bucket assembly in a cost-effective and a time-saving manner.

Exemplary embodiments of bucket assemblies are described above in detail. The systems are not limited to the specific embodiments described herein, but rather, components of each assembly may be utilized independently and separately from other components described herein. Each bucket assembly component can also be used in combination with other bucket assembly and rotor components.

While the invention has been described in terms of various specific embodiments, those skilled in the art will recognize that the invention can be practiced with modification within the spirit and scope of the claims.

What is claimed is:

1. A method of assembling a turbine, said method comprising:

coupling at least one bucket assembly including an upstream side, a downstream side, a blade extending therebetween and a dovetail extending radially inwardly from the blade to a rotor wherein the bucket dovetail includes substantially planar sidewalls; and fixedly securing the at least one bucket assembly to the rotor with a shear pin that has an arcuate cross-sectional profile, and that extends from the bucket assembly upstream side to the bucket assembly downstream side.

2. A method in accordance with claim 1 further comprising forming a channel to extend from the bucket assembly upstream side to the bucket assembly downstream side.

3. A method in accordance with claim 2 wherein fixedly securing the at least one bucket assembly to the rotor comprises inserting a shear pin having an arcuate cross-sectional profile through the channel.

4. A method in accordance with claim 1 further comprising forming a plurality of channels that each extend from the bucket assembly upstream side to the bucket assembly downstream side.

5. A rotor assembly for a turbine, said rotor assembly comprising:

a plurality of bucket assemblies secured to a rotor, each said plurality of bucket assembly comprising an upstream side, a downstream side, a blade, and a dovetail including substantially planar sidewalls, each said blade extending radially from each said dovetail, said plurality of bucket assemblies comprising at least a first bucket assembly, and at least a second bucket assembly; and at least one shear pin having an arcuate cross-sectional profile for securing said first bucket assembly to said rotor such that said shear pin extends from said bucket assembly upstream side to said bucket assembly downstream side.

6. A rotor assembly in accordance with claim 5 wherein said second bucket assembly secured to said rotor by said dovetail.

7. A rotor assembly in accordance with claim 5 wherein said rotor comprises a substantially annular retaining ring for securing said second bucket assembly to said rotor.

8. A rotor assembly in accordance with claim 5 wherein each said dovetails comprises dovetail tangs.

9. A rotor assembly in accordance with claim 5 wherein said at least one shear pin extends through a portion of said rotor.

10. A rotor assembly in accordance with claim 5 wherein said at least one shear pin comprises a pressure side shear pin and a suction side shear pin.

11. A turbine comprising:

at least one rotor assembly comprising at least one rotor;

a plurality of bucket assemblies secured to said rotor, each said plurality of bucket assembly comprising an upstream side, a downstream side, a blade and a dovetail including substantially planar sidewalls, each said blade extending radially from said dovetail, said plurality of bucket assemblies comprising at least one first bucket assembly and at least one second bucket assembly; and at least one shear pin having an arcuate cross-sectional profile for securing said at least one first bucket assembly to said rotor such that said shear pin extends from said bucket assembly upstream side to said bucket assembly downstream side.

12. A turbine in accordance with claim 11 wherein said at least one second bucket assembly is secured to a hook of said rotor by said bucket assembly dovetail.

13. A turbine in accordance with claim 12 wherein said rotor hook comprises a substantially annular retaining ring.

14. A turbine in accordance with claim 11 wherein each said dovetail comprises dovetail tangs.

15. A turbine in accordance with claim 11 wherein said at least one shear pin extends through a portion of said rotor.

16. A turbine in accordance with claim 11 wherein said at least one shear pin comprises a pressure side shear pin and a suction side shear pin.

* * * * *